US007942172B1

(12) United States Patent
Cuellar

(10) Patent No.: US 7,942,172 B1
(45) Date of Patent: May 17, 2011

(54) BOTTLE REFILLING DEVICE

(76) Inventor: Saul E. Cuellar, Cape Coral, FL (US)

( * ) Notice: Subject to any disclaimer, the term of this patent is extended or adjusted under 35 U.S.C. 154(b) by 445 days.

(21) Appl. No.: 12/175,259

(22) Filed: Jul. 17, 2008

(51) Int. Cl.
*B65B 1/04* (2006.01)

(52) U.S. Cl. ..... 141/238; 141/234; 141/237; 141/247

(58) Field of Classification Search ..... 141/234–238, 141/247, 340
See application file for complete search history.

(56) References Cited

U.S. PATENT DOCUMENTS

| | | | | |
|---|---|---|---|---|
| 2,872,953 | A * | 2/1959 | Duncan | 141/237 |
| 3,196,909 | A * | 7/1965 | Monk | 141/237 |
| 4,258,758 | A * | 3/1981 | Nygards | 141/35 |
| 4,880,156 | A * | 11/1989 | Wallet | 232/43.1 |
| 4,911,212 | A | 3/1990 | Burton | |
| 5,381,839 | A * | 1/1995 | Dowd | 141/242 |
| 5,484,002 | A * | 1/1996 | Kupietzky | 141/237 |
| D386,345 | S | 11/1997 | Juarez | |
| 6,412,527 | B1 | 7/2002 | Brice | |
| 6,684,915 | B1 | 2/2004 | Ver Hage | |
| 6,691,902 | B2 | 2/2004 | Gomez | |
| 6,845,794 | B2 | 1/2005 | Johnson | |
| 7,308,919 | B1 * | 12/2007 | Zavala | 141/247 |
| 2004/0007336 | A1 | 1/2004 | Huang | |
| 2009/0301604 | A1 * | 12/2009 | Williams et al. | 141/237 |

* cited by examiner

*Primary Examiner* — Timothy L Maust
(74) *Attorney, Agent, or Firm* — Crossley Patent Law; Mark A. Crossley

(57) ABSTRACT

A bottle refilling device that allows an individual to fill a number of bottles at the same time, with the number of bottles preferably being between 12 to 24 bottles. The device has the shape of a flat panel and has an inlet on the top surface of the flat panel to which a funnel can be attached. A series of disbursement nipples are attached to the bottom surface of the flat panel, to which a number of containers can be attached. Each of the containers can be attached to a particular nipple through engagement with a two-part clamp associated with each nipple. A locking slide system is attached to each of the clamps, allowing the clamps to remain in either a closed position or an open position.

5 Claims, 4 Drawing Sheets

BOTTLE REFILLING DEVICE

BACKGROUND OF THE INVENTION

The present invention concerns that of a new and improved bottle refilling device that allows an individual to fill a number of bottles at the same time, with the number of bottles preferably being between 12 to 24 bottles.

SUMMARY OF THE INVENTION

The present invention concerns that of a new and improved bottle refilling device that allows an individual to fill a number of bottles at the same time, with the number of bottles preferably being between 12 to 24 bottles. The device has the shape of a flat panel and has an inlet on the top surface of the flat panel to which a funnel can be attached. A series of disbursement nipples are attached to the bottom surface of the flat panel, to which a number of containers can be attached. Each of the containers can be attached to a particular nipple through engagement with a two-part clamp associated with each nipple. A locking slide system is attached to each of the clamps, allowing the clamps to remain in either a closed position or an open position.

There has thus been outlined, rather broadly, the more important features of a bottle refilling device that the detailed description thereof that follows may be better understood and in order that the present contribution to the art may be better appreciated. There are, of course, additional features of the bottle refilling device that will be described hereinafter and which will form the subject matter of the claims appended hereto.

In this respect, before explaining at least one embodiment of the bottle refilling device in detail, it is to be understood that the bottle refilling device is not limited in its application to the details of construction and to the arrangements of the components set forth in the following description or illustrated in the drawings. The bottle refilling device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present bottle refilling device. It is important, therefore, that the claims be regarded as including such equivalent constructions insofar as they do not depart from the spirit and scope of the present invention.

It is therefore an object of the present invention to provide a bottle refilling device which has all of the advantages of the prior art and none of the disadvantages.

It is another object of the present invention to provide a bottle refilling device which may be easily and efficiently manufactured and marketed.

It is another object of the present invention to provide a bottle refilling device which is of durable and reliable construction.

It is yet another object of the present invention to provide a bottle refilling device which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
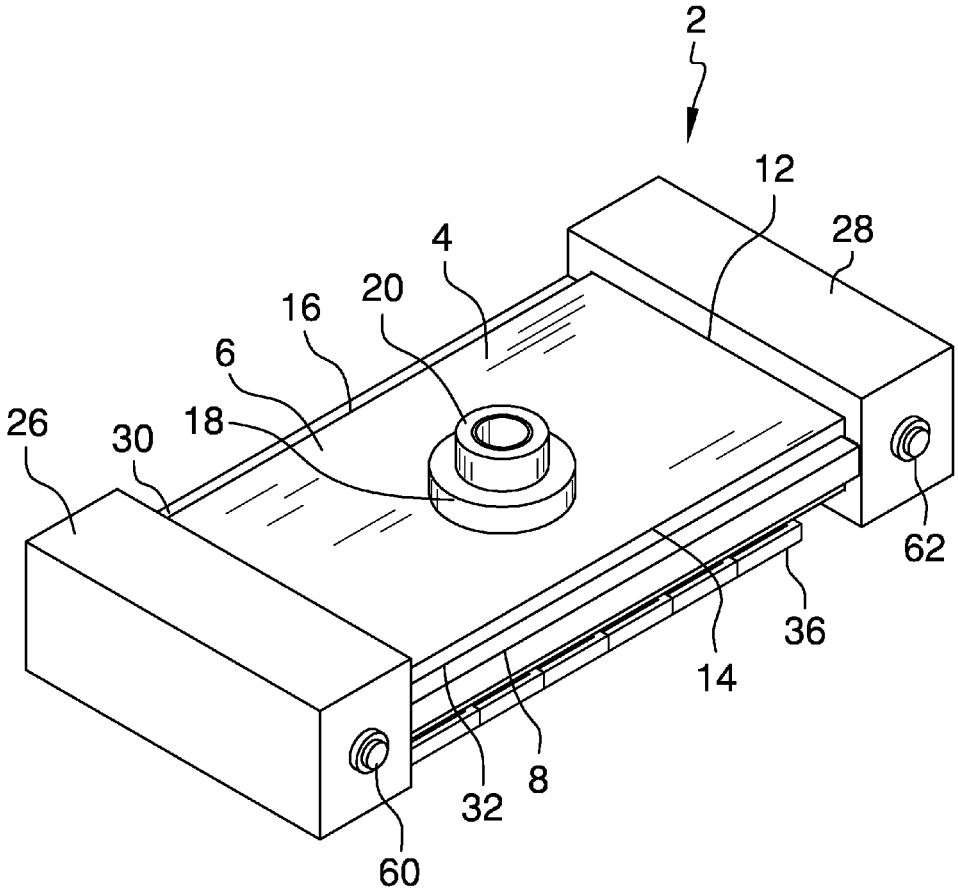
FIG. 1 shows a perspective view of the bottle refilling device.

With reference now to the drawings, and in particular to FIGS. 1 through 4 thereof, a bottle refilling device embodying the principles and concepts of the present invention and generally designated by the reference numeral 2 will be described.

As best illustrated in FIGS. 1 through 4, the bottle refilling device 2 comprises a base 4 that has two surfaces comprising an upper surface 6 and a lower surface 8. The base 4 also has two ends comprising a first end 10 and a second end 12, with the base 4 also having two side edges comprising a first side edge 14 and a second side edge 16.

The base 4 is preferably hollow inside and has a water inlet 18 attached to the upper surface 6 of the base 4, with the water inlet 18 having an associated funnel ring 20. A water funnel 22 can be placed atop the funnel ring 20 and allows an individual to pour a volume of water 24 into the base 4.

A pair of handles 26 and 28 are associated with the base 4, with handle 26 being associated with the first end 10 of the base 4 and handle 28 being associated with the second end 12 of the base 4. Each of the handles has two ends comprising a first end and a second end. Handle 26 has a pair of locking slides 30 and 32 attached to it, with locking slide 30 being attached to the first end of handle 26 and locking slide 32 being attached to the second end of handle 26. Handle 28 has a pair of locking slides 34 and 36 attached to it, with locking slide 34 being attached to the first end of handle 28 and locking slide 36 being attached to the second end of handle 28. Locking slides 30 and 34 therefore interact with one another, while locking slides 32 and 36 interact with one another.

Each of the locking slides 30-36 have associated interlocking teeth 38, allowing the two pairs of locking slides that interact with one another to have any one of a number of positions. The interlocking teeth 38 also allow each pair of locking slides to effectively be able to "hold" a position once they are set in relation to each other.

Figure 2:
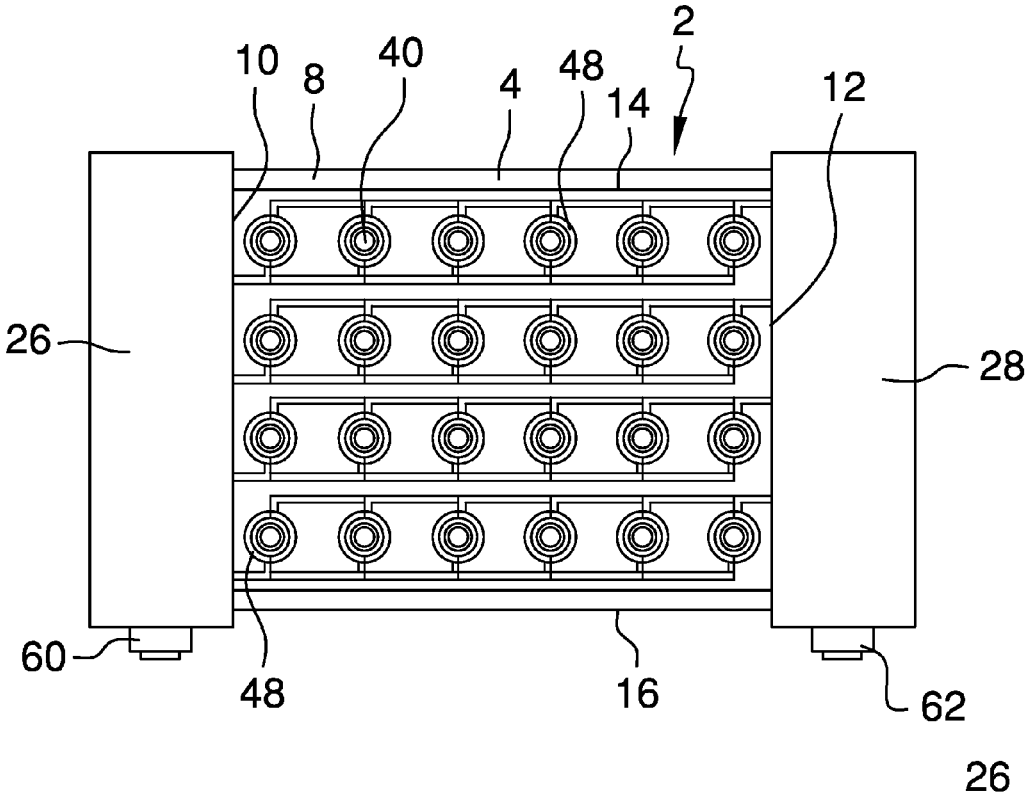
FIG. 2 shows a bottom view of the bottle refilling device as it would appear with each clamp associated with a nipple being in a closed position.
Figure 3:
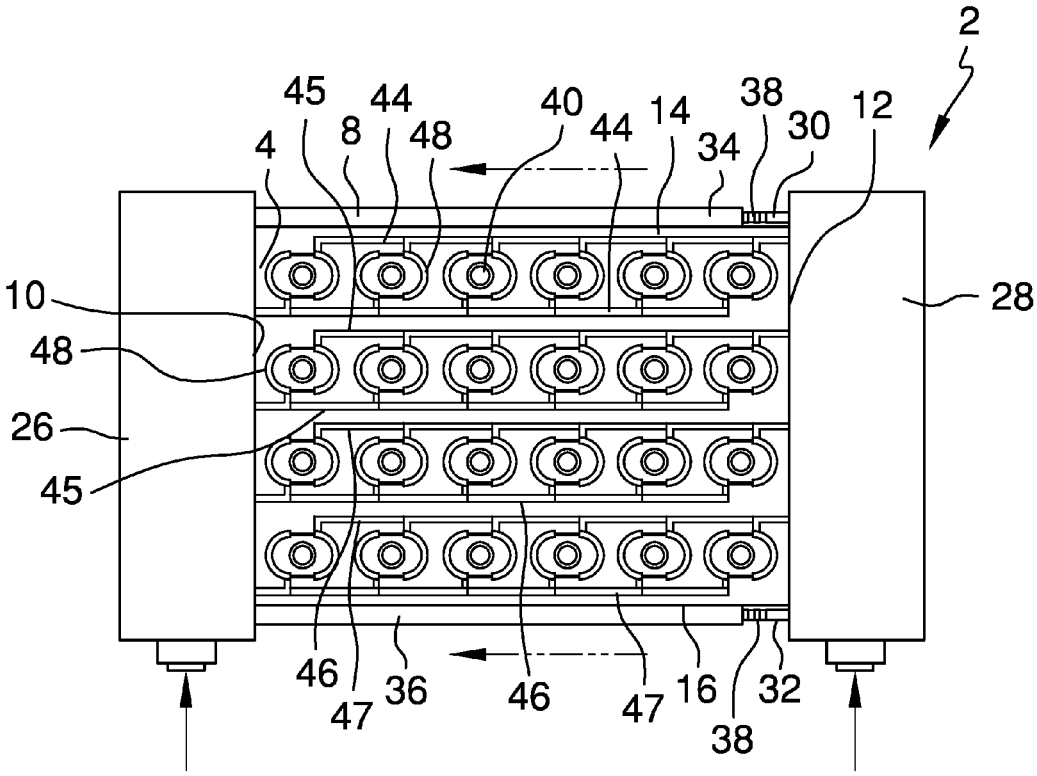
FIG. 3 shows a bottom view of the bottle refilling device as it would appear with each clamp associated with a nipple being in an open position.
Figure 4:
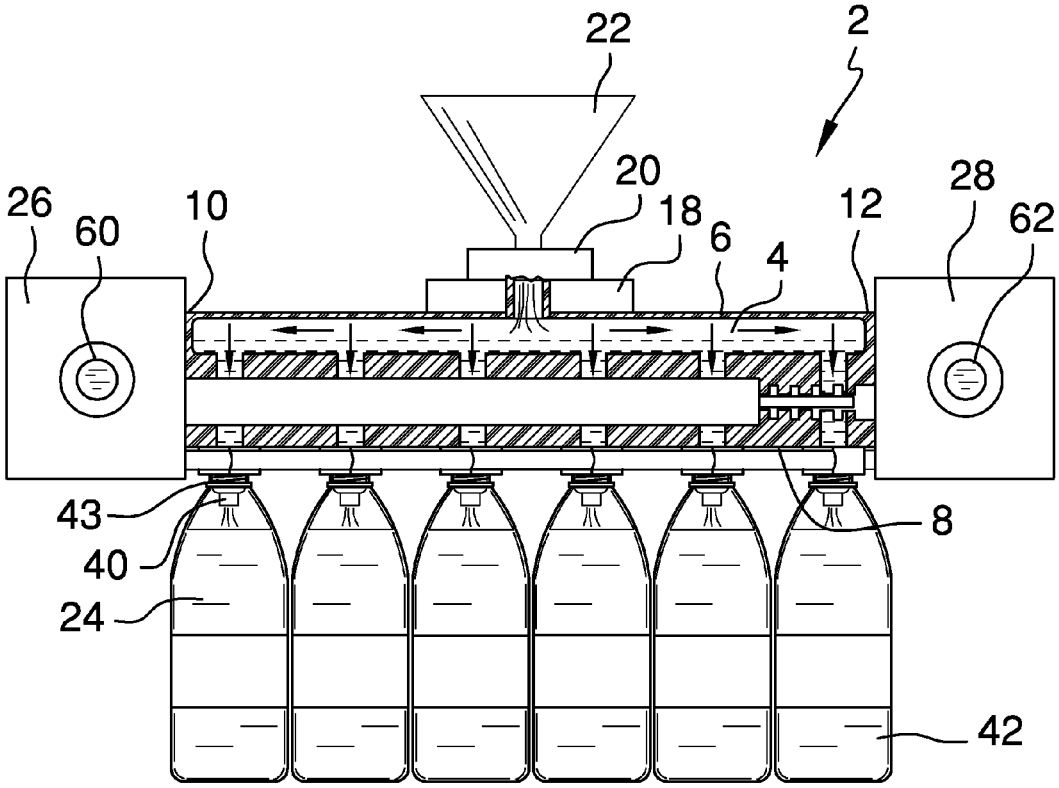
FIG. 4 shows a bottom view of the bottle refilling device as it would appear with each clamp associated with a nipple being in an open position.

A series of nipples 40 are attached to the lower surface 8 of the base 4, allowing one or more containers 42 to be attached to the nipples to allow an individual to fill up the containers 42 with water. The configuration of the nipples 40 can vary widely, but the preferred configuration is shown in FIGS. 2 and 3, which shows four rows of six nipples 40 each.

The device 2 also has a method to effectively lock a container 42 onto a nipple 40 once it has been connected to a nipple 40. Handles 26 and 28 each have four mounts 44-47 that extend outward from each handle toward the other handle. Each mount 44-47 is closely located flush with the lower surface 8 of the base 4. The four mounts 44-47 on each handle comprise a first mount 44, a second mount 45, a third mount 46, and a fourth mount 47.

Each mount on each handle also has a plurality of half-rings 48 attached to it in a linear, evenly-spaced manner. The number of half-rings 48 on each mount are designed to equal the number of nipples 40 in the particular row to which the mount is associated with on the base 4.

When the locking slides 30-36 are pulled apart from one another, an individual can attach the lip 43 of a container 42 to each of the nipples 40 associated with the device 2. Once the desired number of containers 42 have been attached to the device 2, the individual can then push the two handles 26 and 28 toward one another. Due to the configuration of the various half-rings 48 located on the mounts 44-47, two half-rings will converge around each nipple to form a tight, lip-gripping full ring 50 that will hold the lip 43 of a container 42 in place (even if there is no surface underneath the container 42).

A pair of locking buttons 60 and 62 are associated with each handle 26 and 28, respectively, allowing the handles 26 and 28 to be pulled apart from and pushed together when desired. The first locking button 60 controls the extension and withdrawal of the plurality of mounts attached to the first handle 26, while the second locking button 62 controls the extension and withdrawal of the plurality of mounts attached to the second handle 28. Otherwise, the various locking slides 30-36 are in a fixed relationship with one another while the buttons 60 and 62 are not being engaged.

When the first handle 26 and the second handle 28 are in the positions in which they are closest to one another, the half-rings associated with each nipple 40 will compress the lip 43 of a container 42 that has been attached to the particular nipple 40, thereby holding the container in place. Once the handles 26 and 28 have been pulled apart, the container 42 will no longer be held in place, at which time, the container 42 can be removed as needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A bottle refilling device comprising a base, the base having an upper surface and a lower surface, the base also having two ends comprising a first end and a second end, the base also having two side edges comprising a first side edge and a second side edge, means for filling up the base with a volume of liquid, a plurality of containers, wherein each container has an upper lip attached to the container, means for filling up each container with some of the liquid of the volume of liquid, wherein the means for filling up the base with a volume of liquid further comprises an inlet located on the upper surface of the base, a funnel ring associated with the inlet, a funnel, wherein the funnel is attached to the funnel ring, wherein the volume of liquid is poured into the funnel, wherein the volume of liquid preferably comprises a volume of water, wherein the means for filling up each container with some of the liquid of the volume of liquid further comprises a plurality of nipples attached to the lower surface of the base, and means for removably connecting each container to a nipple attached to the base, wherein the means for removably connecting each container to a nipple attached to the base further comprises a pair of handles comprising a first handle and a second handle, the first handle being attached to the first end of the base, the second handle being attached to the second end of the base, wherein each handle has two ends comprising a first end and a second end, a first pair of locking slides comprising a first locking slide and a second slide, wherein the first locking slide of the first pair of locking slides is attached to the first end of the first handle, further wherein the second locking slide of the first pair of locking slides is attached to the second end of the first handle, a second pair of locking slides comprising a first locking slide and a second slide, wherein the first locking slide of the second pair of locking slides is attached to the first end of the second handle, further wherein the second locking slide of the second pair of locking slides is attached to the second end of the second handle, a plurality of interlocking teeth, wherein the interlocking teeth are attached to each of the locking slides of both the first pair of locking slides and the second pair of locking slides, a plurality of mounts attached to each handle, wherein each mount extends outward from each handle toward the other handle, further wherein each mount is located flush with the lower surface of the base, a plurality of half-rings attached to each mount, wherein the half-rings attached to each mount are attached in a linear, evenly-spaced manner, wherein the number of half-rings on each mount equals the number of nipples in a particular row to which the mount is associated with on the base, and means for adjusting the half-rings on the various mounts attached to the first handle in relation to the half-rings on the various mounts attached to the second handle.

2. A bottle refilling device according to claim 1 wherein the means for adjusting the half-rings on the various mounts attached to the first handle in relation to the half-rings on the various mounts attached to the second handle further comprises (a) a pair of locking buttons comprising a first locking button and a second locking button, wherein the first locking button is attached to the first handle, further wherein the second locking button is attached to the second handle, (b) wherein the first locking button controls the extension and withdrawal of the plurality of mounts attached to the first handle, (c) further wherein the second locking button controls the extension and withdrawal of the plurality of mounts attached to the second handle.

3. A bottle refilling device according to claim 2 wherein the number of mounts attached to each handle numbers four mounts.

4. A bottle refilling device according to claim 3 wherein the number of nipples attached to the lower surface of the base equals twenty-four (24) nipples.

5. A bottle refilling device comprising (a) a base, the base having an upper surface and a lower surface, the base also having two ends comprising a first end and a second end, the base also having two side edges comprising a first side edge and a second side edge, (b) means for filling up the base with a volume of liquid, the volume of liquid preferably comprises a volume of water, said means further comprising (i) an inlet located on the upper surface of the base, (ii) a funnel ring associated with the inlet, (iii) a funnel, wherein the funnel is attached to the funnel ring, (iv) wherein the volume of liquid is poured into the funnel, (c) a plurality of containers, wherein each container has an upper lip attached to the container, and (d) means for filling up each container with some of the liquid of the volume of liquid, said means further comprising (i) a plurality of nipples attached to the lower surface of the base, wherein the number of nipples preferably equals twenty-four (24) nipples, and (ii) means for removably connecting each container to a nipple attached to the base, said means further comprising (1) a pair of handles comprising a first handle and a second handle, the first handle being attached to the first end of the base, the second handle being attached to the second end of the base, wherein each handle has two ends comprising a first end and a second end, (2) a first pair of locking slides comprising a first locking slide and a second slide, wherein the first locking slide of the first pair of locking slides is attached to the first end of the first handle, further wherein the second locking slide of the first pair of locking slides is attached to the second end of the first handle, (3) a second pair of locking slides comprising a first locking slide and a second slide, wherein the first locking slide of the second pair of locking slides is attached to the first end of the second handle, further wherein the second locking slide of the second pair of locking slides is attached to the second end of the second handle, (4) a plurality of interlocking teeth, wherein the interlocking teeth are attached to each of the locking slides of both the first pair of locking slides and the second pair of locking slides, (5) a plurality of mounts attached to each handle, wherein the number of mounts attached to each handle numbers four mounts, wherein each mount extends outward from each handle toward the other handle, further wherein each mount is located flush with the lower surface of the base, (6) a plurality of half-rings attached to each mount, wherein the half-rings attached to each mount are attached in a linear, evenly-spaced manner, wherein the number of half-rings on each mount equals the number of nipples in a particular row to which the mount is associated with on the base, (7) means for adjusting the half-rings on the various mounts attached to the first handle in relation to the half-rings on the various mounts attached to the second handle, said means further comprising a pair of locking buttons comprising a first locking button and a second locking button, wherein the first locking button is attached to the first handle, further wherein the second locking button is attached to the second handle, wherein the first locking button controls the extension and withdrawal of the plurality of mounts attached to the first handle, further wherein the second locking button controls the extension and withdrawal of the plurality of mounts attached to the second handle.

* * * * *